United States Patent [19]

Koenig

[11] Patent Number: 4,915,308

[45] Date of Patent: Apr. 10, 1990

[54] BARREL INJECTOR SCREW

[76] Inventor: Larry Koenig, 4425 Marketing Pl., Groveport, Ohio 43125

[21] Appl. No.: 345,386

[22] Filed: May 1, 1989

[51] Int. Cl.[4] ..... B02C 19/22

[52] U.S. Cl. ..... 241/152 R; 241/260.1

[58] Field of Search ..... 241/260.1, 29, 152 R, 241/DIG. 38; 425/202, 205

[56] References Cited

U.S. PATENT DOCUMENTS

| | | | |
|---|---|---|---|
| 4,253,615 | 3/1981 | Koenig | 241/260.1 X |
| 4,509,700 | 4/1985 | Svengren | 241/260.1 X |
| 4,512,523 | 4/1985 | Higashimoto | 241/260.1 X |

FOREIGN PATENT DOCUMENTS

| | | | |
|---|---|---|---|
| 2238532 | 2/1974 | Fed. Rep. of Germany | 241/260.1 |
| 16768 | 7/1914 | United Kingdom | 241/152 R |

*Primary Examiner*—Mark Rosenbaum

*Attorney, Agent, or Firm*—Thompson, Hine & Flory

[57] ABSTRACT

An auger shredder and feeder system which includes a primary housing for receiving material to be ground and shredded, a primarily auger rotatably mounted within a grinding chamber formed in the housing, an extrusion tube for receiving material ground and shredded within said grinding chamber, a secondary housing having a generally tubular side wall and communicating with the extrusion tube, and a secondary auger rotatably mounted within the secondary housing. Material deposited in the primary housing is crushed and shredded, then pumped by the primary auger through the extrusion tube where forms a plug of material. As the plug progresses into the secondary housing, it is further shredded and compressed by the secondary auger.

11 Claims, 4 Drawing Sheets

BARREL INJECTOR SCREW

BACKGROUND OF THE INVENTION

The present invention relates to shredding and grinding systems and, more particularly, to shredding and grinding systems which incorporate multiple augers.

In order to reduce large, bulky items such as wood pallets, crates, 55 gallon drums of liquid or hardened material, railroad ties and the like, shredding machines have been developed which incorporate a single rotating auger to reduce and compress such waste material. An example of such a device is disclosed in Koenig U.S. Pat. No. 4,253,615. That patent shows an auger shredder having a frame which defines a grinding chamber, a tapered auger mounted within the grinding chamber and powered by a low-speed hydraulic motor, and a discharge extrusion tube which extends outwardly from the front wall of the grinding chamber and is concentric with a rotational axis of the auger. The auger includes a central shaft and a tapered flight having teeth projecting radially from the flight periphery. The teeth mesh with stationary breaker bars mounted on the bottom of the grinding chamber, which is concave and tapered to follow contour of the auger flight and guide material toward the discharge extrusion tube.

Material deposited in the grinding chamber is grabbed by the teeth and pulled downwardly where it is broken up by the meshing action of the teeth and breaker bars. The broken material is further shredded and compressed by the pumping action of the tapered flight, which forces the material forwardly to the extrusion tube. Once in the extrusion tube, which preferably is of a frusto-conical shape, the material is further compressed and shredded by the action of the leading edge of the flight upon the rear face of the material within the tube.

The material within the tube forms a plug which may act as barrier to prevent back flow of harmful gases or flames. This aspect of the design is particularly useful when the auger shredder feeds shredded material to an incinerator.

However, there exists a disadvantage with this type of grinding device in that the extrusion tube must be rectilinear in shape; that is, it cannot curve or angle away from the discharge opening since it is difficult to push the plug through an angled tube without creating jams. Consequently, such grinding devices must be elevated and otherwise oriented so that the discharge tube is substantially at the same level as the inlet to the receptacle and is aligned with the inlet of the receptacle. Furthermore, since these devices rely upon a gravity feed to force material into the grinding chamber, the grinding chamber must be held substantially horizontal. This often requires that the device be elevated on a support framework if the inlet to the incinerator or other receptacle is also elevated.

Another disadvantage with such devices is that, with a single auger, the compression ratio achievable by its auger—which is defined as the reduction in volume between successive flights from the large diameter end of the auger to the small diameter end—of greater than 6:1 are difficult to obtain and result in increased power requirements, reduced flow rate of material and build up of material on the front wall of the grinding chamber.

Accordingly, there is a need for an auger shredder system which can propel ground material from the grinding chamber to an inlet at a different elevation. There is also a need for an auger shredder system in which compression ratios of greater than 6:1 are achievable.

SUMMARY OF THE INVENTION

The present invention is an auger shredder and feeder system which is capable of shredding and reducing material to a finer consistency than prior art systems and, simultaneously, pumping that material upwardly or downwardly from the grinding chamber to a receptacle. The invention comprises a primary housing defining a grinding chamber within which is rotatably mounted a primary auger, an extrusion tube forming an outlet from the grinding chamber, a secondary, tubular housing communicating with the extrusion tube and a secondary auger rotatably mounted within the secondary housing.

Material to be shredded and compressed is deposited within the primary grinding chamber and is shredded and compressed as it is pumped along the length of the primary housing grinding chamber and into the extrusion tube by the primary auger. Once within the extrusion tube, the material forms a plug in which its rear face is acted upon by the leading edge of the primary auger to further grind and reduce the size of the particles of material. As the plug progresses from the extrusion tube into the secondary housing, it is engaged by the flight of the secondary auger and pumped along the length of the secondary housing. Since the secondary housing is at an angle to the extrusion tube, the material is diverted in a direction away from the centerline of the extrusion tube. Accordingly, the material may be pumped upwardly, downwardly, or to the side of the extrusion tube, as needed, to the inlet of a receptacle such as an incinerator. Consequently, a greater flexibility is provided in mounting arrangements for the primary auger.

In addition, as the plug progresses into the secondary grinding chamber, the leading portion is "shaved" or sheared by the rotating auger which reduces further the particle size. In a preferred embodiment, the outlet opening of the secondary housing is smaller in diameter than the extrusion tube, and the secondary auger reduced in size accordingly, so that additional compression and reduction of material size can be accomplished. Typically, volume reductions of 14:1 to 16:1 are achievable over the entire shredder and feeder system.

Accordingly, it is an object of the present invention to provide an auger shredder and feeder system in which the output of the primary grinding chamber can be displaced upwardly, downwardly or to the side of the central access of the outlet opening of the grinding chamber; an auger shredder and feeder system in which volume reductions of 14:1 to 16:1 are achievable; an auger shredder and feeder system in which individual particle size reduction can be increased over single auger systems with virtually no reduction in processing rate; and an auger shredder and feeder system which is rugged and is readily adaptable for use in hazardous environments and in combination with incinerators.

Other objects and advantages of the invention will be apparent from the following description, the accompanying drawings and the appended claims.

BRIEF DESCRIPTION OF THE DRAWINGS

FIG. 3 is a schematic side elevation of another embodiment of the invention in which the secondary auger is at skewed angle to the discharge tube.

DETAILED DESCRIPTION OF THE PREFERRED EMBODIMENTS

Figure 1:
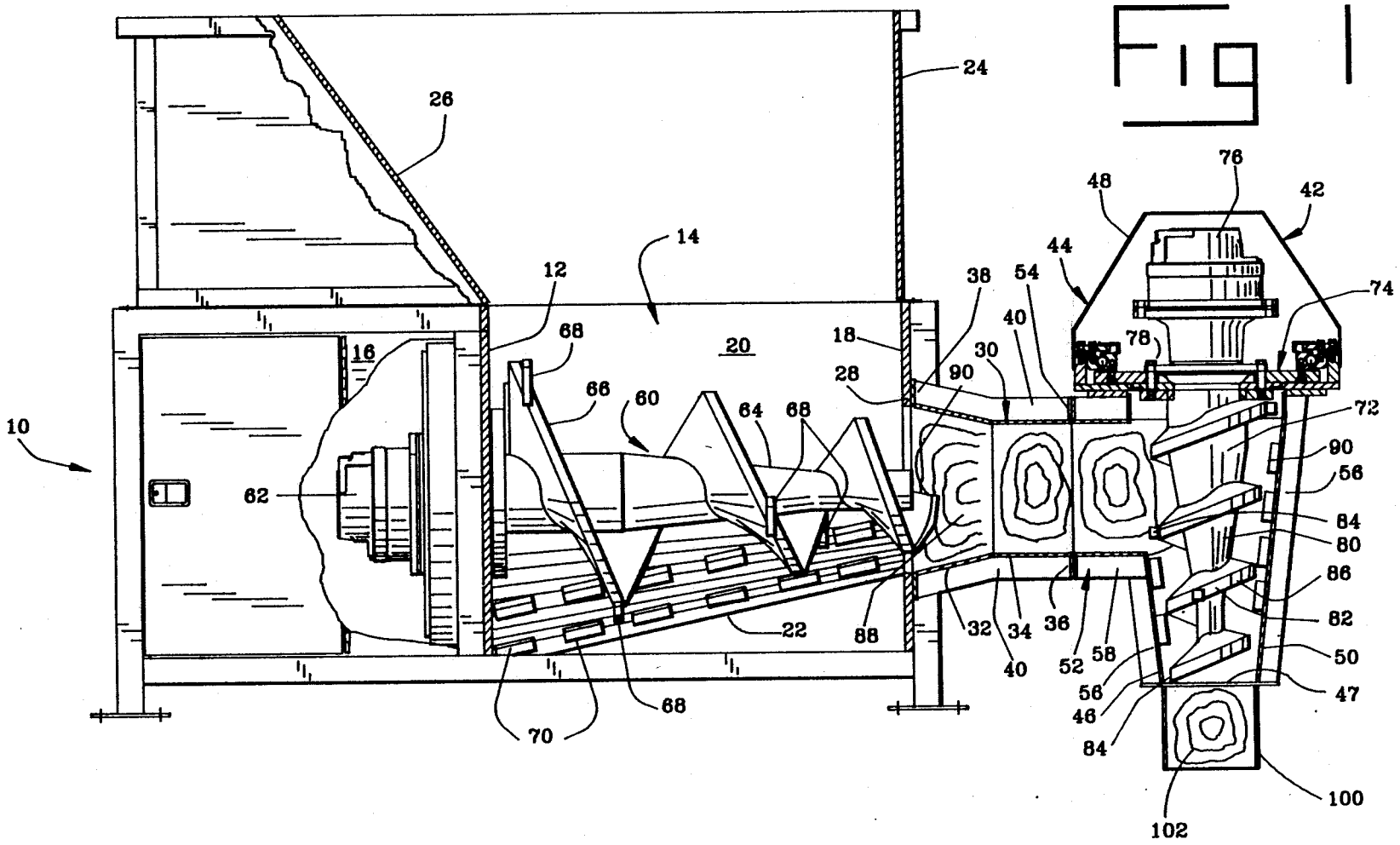
FIG. 1 is a schematic side elevation, partially in section, of the auger shredder and feeder system of the present invention.

As shown in FIG. 1, the auger shredder and feeder system of the present invention includes a primary housing, generally designated 10, which is divided by a bulkhead 12 into a grinding chamber 14 and a motor housing enclosure 16. The bulkhead 12 forms the rear wall of the grinding chamber 14. The grinding chamber 14 is also defined by a front wall 18, opposing side walls, side walls 20 (only one of which is shown) and an arcuate bottom 22.

The top of the grinding chamber 14 is open and communicates with a hopper 24. Hopper 24 includes a sloped rear wall 26 which guides material deposited in the hopper downwardly through the opening between the hopper and grinding chamber 14, and into the grinding chamber. The front wall 18 of the grinding chamber includes a discharge opening 28 which communicates with an extrusion tube 30. The extrusion tube 30 includes a frusto-conical section 32 and a substantially cylindrical section 34 having a diameter reduced from that of the discharge opening 28. The cylindrical section 34 terminates in an annular flange 36 and the frusto-conical section 32 is attached to an annular mounting plate 38. Ribs 40 extend outwardly from the extrusion tube 30 and are attached at their ends to flange 36 and mounting plate 38. Mounting plate 38 is attached to the front wall 18 of the grinding chamber 14.

A secondary auger assembly, generally designated 42, includes a secondary housing, generally designated 44, having a tubular wall 46 defining a secondary grinding chamber 47 and secondary motor housing 48. Wall 46 is conical in shape and tapers forwardly to a discharge opening 50 which is smaller in diameter than the cylindrical section 34 which conveys the output of the primary grinding chamber 14. The secondary grinding chamber wall 46 includes an inlet conduit 52 having a mounting flange 54 attached by bolts (not shown) to flange 36 of the extrusion tube 30. As seen in FIG. 1, the lower portion of chamber 47 is connected to extrusion tube 100. Present in tube 100 is secondary plug 102.

The secondary housing 44 includes external support ribs 56 which stiffen the secondary grinding chamber wall 46. Similarly, the inlet conduit 52 includes a support rib 58 which extends from the flange 54 to the housing of the grinding chamber 47.

A primary auger 60 is rotatably mounted within the grinding chamber 14 by bearings (not shown) supported by the rear wall bulkhead 12. A motor 62 is also mounted on the rear wall of the bulkhead 12 within the motor enclosure 16. Preferably, motor 62 is a hydraulic motor driven by conventional hydraulic apparatus located within the motor enclosure 16. A preferred main bearing and bearing seal design is disclosed in copending application Ser. No. 345,330, filed Apr. 27, 1989 (attorney docket K1515-008), hereby incorporated by reference.

The primary auger 60 includes a tapered, conical shaft 64 and a tapered flight 66 which tapers in diameter from the bulkhead 12 to the front wall 18. A plurality of teeth 68 extend radially outwardly from the periphery of the flight and mesh with a plurality of stationary breaker bars 70 mounted on the bottom 22 of the grinding chamber 14.

Similarly, secondary auger assembly 42 includes a secondary auger 72 which is attached to a bearing assembly, generally designated 74, which in turn is mounted on the motor housing 48. A secondary drive motor 76 is attached to the bearing assembly by bolts 78 and rotates the secondary auger 72. The structure of the bearing assembly 74 is described in greater detail with respect to FIG. 4. Motor 76 preferably is a hydraulic motor which may be driven by the same source of hydraulic pressure that drives motor 62.

Auger 72 includes shaft 80 having a flight 82 with a plurality of teeth 84 projecting radially form its periphery and spaced along its length. The teeth 84 mesh with breaker bars 86 spaced about the inner periphery and length of wall 46.

The operation of the auger shredder and feeder system is as follows. Material to be ground and shredded is deposited downwardly through the open top of the hopper 24 where it passes through the hopper and into the grinding chamber 14 of the primary housing 10. There, the material is grabbed by the teeth 68 of the primary auger 60, pulled downwardly between the teeth and breaker bars 70, and is shredded and crushed as it is pumped forwardly by the flight 66. Since the flight 66 is tapered, the material is compressed as it is pumped forwardly toward the front wall 18, and the concave, sloping floor 22 guides the material into the extrusion tube 30.

There, the material is compressed further by the tapered section 32 and the constricted size of the extrusion tube 30 and forms a plug 88 beyond the leading edge 90 of the auger 60.

Typically, the pumping volume between the successive flights of the primary auger 60 reduces along the length of grinding chamber 14 by a ratio of about 3:1. Further, there is additional reduction in the volume being pumped by way of the frusto-conical section 32 of the extrusion tube 30. Consequently, the final dimensions of the plug 88 are determined by the diameter and cross sectional area of the cylindrical section 34 of the extrusion tube 30.

As the plug 88 progresses along the inlet conduit 52, it is sheared by the secondary auger 72. Before the plug contacts the shaft 80, the flight 82 and teeth 84 grab the leading surface of the plug and shave off portions which are then pumped along the length of the grinding chamber 47. As the material is pumped, it is further reduced in particle prize by the meshing of the teeth 84 with the breaker bars 86.

Since the overall diameter of the secondary grinding chamber 47 is less than the diameter of the inlet conduit 52 at the largest diameter of the secondary grinding chamber, and the grinding chamber tapers to the discharge opening 50, material is compressed further simultaneously with a reduction in particle size. Consequently, an overall reduction in pumping volume from the primary grinding chamber to the discharge opening 50 can accomplished on the order of 6:1 to 8:1, with an overall volume reduction of 14:1 to 16:1 being achievable.

Figure 2:
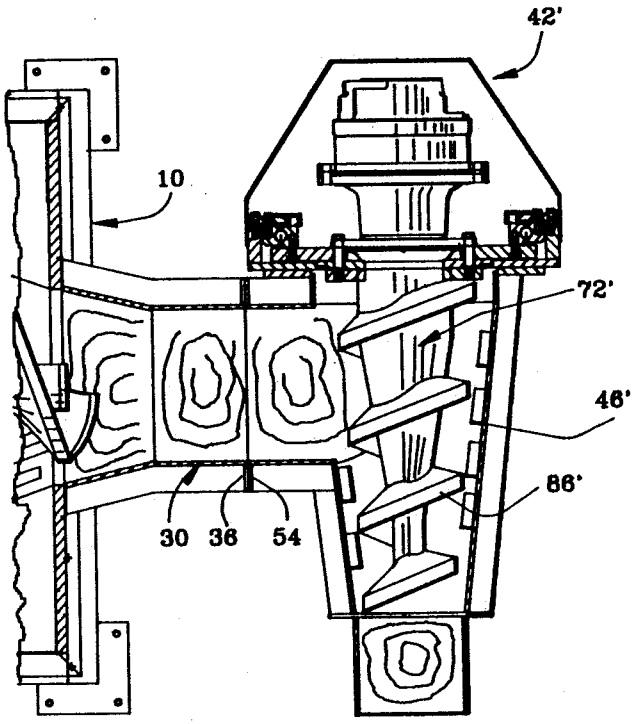
FIG. 2 is a top plan view of an alternate embodiment of the auger shredder and feeder system of FIG. 1 in which the secondary auger displaces material sidewardly of the extrusion tube.
Figure 9:
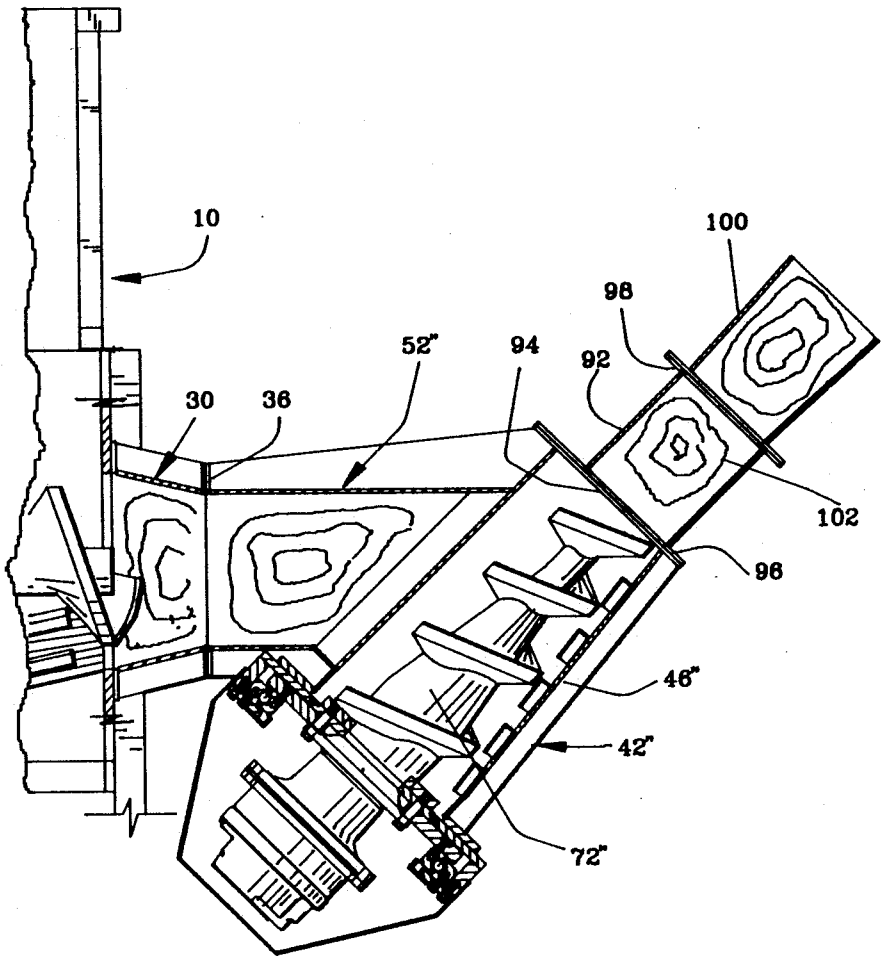

The auger shredder and feeder system of FIG. 1 shows a secondary auger assembly 42 which changes the direction of material flow from a horizontal direction to a downward direction which perpendicular to the horizontal material flow. As shown in FIG. 2, in an alternate embodiment of the invention, the secondary auger assembly of 42' is oriented to direct material in a direction which is perpendicular to the material flow through the extrusion tube 30 but on the same horizontal plane. This adjustment can be accomplished simply by changing the mating relationship between the flange 36 and the corresponding flange 54 of the secondary auger assembly 42'.

Also in the secondary auger assembly 42', a secondary auger 72' is employed which does not include teeth projecting radially from its flight 86'. Consequently, the grinding chamber 46' does not include breaker bars as does the grinding chamber 47 of FIG. 1. This embodiment is better suited for pumping material of a finer consistency which does not require the further shredding action resulting from the meshing of teeth and breaker bars in the secondary auger assembly.

Another embodiment of the invention is shown in FIG. 3. In this embodiment, the secondary auger assembly 42'' is attached to the flange 36 of the extrusion tube 30 by an inlet conduit 52'' which orients the auger assembly at a skewed angle to the flow of material from the extrusion tube. In the embodiment of FIG. 3, this skewed angle is at approximately 45° to the flow of material. In addition, the grinding chamber 46'' includes a secondary extrusion tube 92 which is attached to a front wall flange 94 of the secondary housing by an extrusion tube flange 96. The extrusion tube 92 includes a forward flange 98 which may be attached to an inlet 100 or receptacle such as an incinerator.

In operation, the auger 72'' of the secondary auger assembly 42'' pumps material upwardly into the extrusion tube 92 where a secondary plug 102 is formed. This secondary plug 102 provides a barrier to prevent backflow of hazardous fumes or flames which may travel through the secondary plug 102. The shredder and feeder system shown in FIG. 3 provides an additional measure of safety in that the plug (not shown) which would be created within the extrusion tube 30 and inlet conduit 52'' would act as a secondary barrier to prevent the back flow of hazardous fumes or flames in the event that the plug 102 is burned through.

Figure 4:
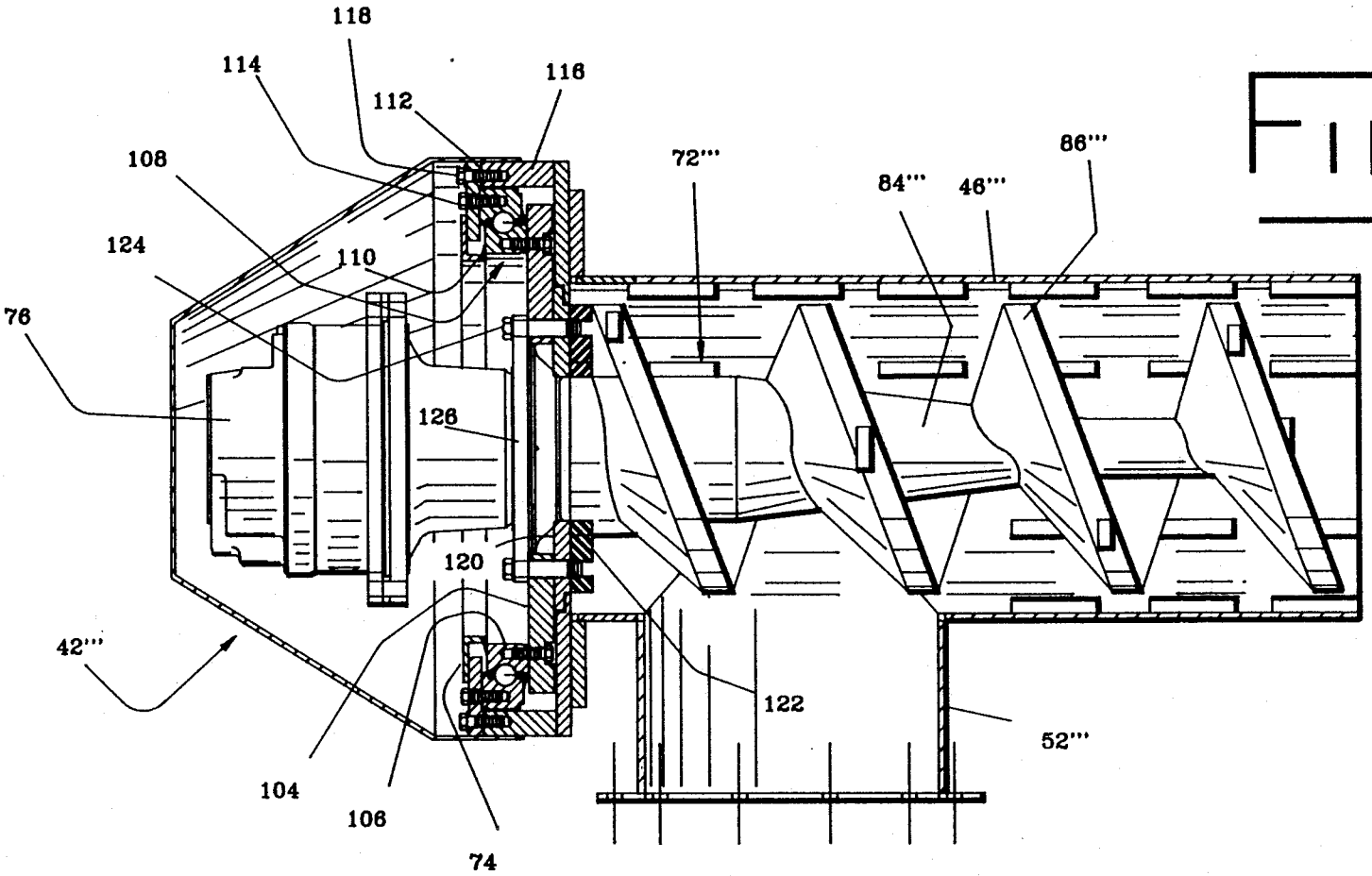
FIG. 4 is a detail of another embodiment of the invention showing a modified secondary housing and secondary auger.

FIG. 4 shows an alternate embodiment of a secondary auger assembly 42'''. This auger assembly 42''' differs from the assemblies disclosed in FIGS. 1–3 in that the grinding chamber is defined by a cylindrical wall 46''' which does not taper along its length. The auger 72''' mounted within the grinding chamber 46''' includes a tapered shaft 84''' and a non-tapering flight 86'''. However, the bearing assembly 74 is the same as the bearing assembly shown in the previous FIGURES. Specifically, bearing assembly 74 includes an annular bearing disc 104 which is attached to the inner race 106 of a slewing bearing 108. The outer race 110 is attached to an annular mounting plate 112 by bolts 114, and the annular mounting plate is attached to a side wall extension 116 by bolts 118.

A spacer disc 120 is positioned in abutting relationship to the bearing disc 104 and, in turn, supports the auger base plate disc 122. Bolts 124 extend through the output flange 126 of the motor 76, the bearing disc 104, spacer plate 120 and are threaded into the base plate 122.

In operation, the secondary auger assembly 42''' receives material from the extrusion tube (not shown in FIG. 4) through the inlet conduit 52''' and into the grinding chamber defined by the cylindrical housing 46'''. The material is then pumped in a direction perpendicular to the incoming material direction without additional compression of the material. This operation is preferable when pumping slurry, liquid styrene and other incompressible liquids which were deposited into the primary grinding chamber 14 in containers such as 55 gallon drums. Consequently, the shredded drum or other container material, along with the liquid, is pumped through the secondary housing 46''' by the auger 72''' into the intended recepticle.

While the forms of apparatus herein described constitute preferred embodiments of this invention, it is to be understood that the invention is not limited to these precise forms of apparatus, and that changes may be made therein without departing from the scope of the invention.

What is claimed is:

1. An auger shredder and feeder system comprising:

a primary housing having an open top for receiving material, a rear wall, a front wall having a central discharge opening, opposing downwardly and inwardly slanted side walls and an arcuate bottom, said side walls and bottom tapering toward said discharge opening and defining a grinding chamber;

a primary auger rotatably mounted on said rear wall within said grinding chamber and having a central shaft and flight extending through said discharge opening, said flight tapering in diameter from said rear wall to said discharge opening in conformity with said grinding chamber;

said flight including tooth means and said bottom including breaker bar means, meshing with said tooth means, for grabbing and breaking up material;

an extrusion tube communicating with said discharge opening and sized such that material ground, shredded and compressed in said grinding chamber is pumped beyond said primary auger to form a plug in said tube;

a secondary housing having a generally tubular side wall with an inlet opening connected to said extrusion tube at an angle thereto, a rearward closed end and an open forward end;

a secondary auger rotatably mounted rearwardly of said secondary grinding chamber and extending through said secondary housing, said secondary auger having a flight sized such that a plug in said tube urged forwardly by said primary auger is sheared by said flight and pumped along said secondary housing; and means for rotating said primary and secondary augers.

2. The system of claim 1 wherein said secondary housing is frusto-conical in shape, tapering to said open forward end; and said flight of said secondary auger tapers in diameter corresponding to said housing.

3. The system of claim 2 wherein said secondary auger includes a shaft tapering toward said open forward end.

4. The system of claim 1 wherein said housing are cylindrical in shape.

5. The system of claim-4 wherein said flight of said secondary auger is uniform in diameter.

6. The system of claim 5 wherein said secondary auger includes a shaft tapering from a said rearward end to said forward end.

7. The system of claim 1 wherein said tube intersects said secondary housing at a skewed angle.

8. The system of claim 1 wherein said open forward end has a cross sectional area less than a cross sectional area of said extrusion tube at a point of intersection with said secondary housing, whereby material in said secondary housing is compressed further.

9. The system of claim 1 wherein said secondary housing includes a secondary extrusion tube extending from said open forward end thereof, said secondary tube being shaped to allow formation of a plug of material therein pumped from said secondary grinding chamber.

10. The systems of claim 9 wherein said secondary extrusion tube is shaped to provide additional compression of material received therein from said secondary housing.

11. The system of claim 1 wherein said secondary auger includes a plurality of teeth on said flight thereof; and said secondary housing includes breaker bar means for meshing with said teeth, thereby grabbing and shredding material received from said primary housing.

* * * * *